US009494317B2

(12) United States Patent
Krichtafovitch et al.

(10) Patent No.: US 9,494,317 B2
(45) Date of Patent: Nov. 15, 2016

(54) ELECTRODYNAMIC COMBUSTION CONTROL WITH CURRENT LIMITING ELECTRICAL ELEMENT

(71) Applicant: ClearSign Combustion Corporation, Seattle, WA (US)

(72) Inventors: Igor A. Krichtafovitch, Kirkland, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 84 days.

(21) Appl. No.: 14/643,063

(22) Filed: Mar. 10, 2015

(65) Prior Publication Data

US 2015/0241057 A1 Aug. 27, 2015

Related U.S. Application Data

(63) Continuation of application No. PCT/US2013/059061, filed on Sep. 10, 2013.

(60) Provisional application No. 61/731,639, filed on Nov. 30, 2012, provisional application No. 61/698,820, filed on Sep. 10, 2012.

(51) Int. Cl.

| | |
|---|---|
| ***F23C 99/00*** | (2006.01) |
| ***F02P 7/00*** | (2006.01) |
| ***F23Q 3/00*** | (2006.01) |
| ***F23Q 7/18*** | (2006.01) |

(52) U.S. Cl.

CPC ..... *F23C 99/001* (2013.01); *F02P 7/00* (2013.01); *F23Q 3/00* (2013.01); *F23Q 7/18* (2013.01)

(58) Field of Classification Search

CPC ..... F23C 99/001; F23C 99/00; F23Q 3/00; F23Q 7/18; F02P 7/00

USPC ..... 431/2, 253, 354, 66; 123/644, 624

See application file for complete search history.

(56) References Cited

U.S. PATENT DOCUMENTS

| | | | |
|---|---|---|---|
| 2,604,936 | A | 7/1952 | Kaehni et al. |
| 3,167,109 | A | 1/1965 | Wobig |
| 3,224,485 | A | 12/1965 | Blomgren et al. |
| 3,306,338 | A | 2/1967 | Wright et al. |

(Continued)

FOREIGN PATENT DOCUMENTS

| | | |
|---|---|---|
| EP | 0844434 | 5/1998 |
| EP | 1139020 | 8/2006 |

(Continued)

OTHER PUBLICATIONS

F. Altendorfner et al., Electric Field Effects on Emissions and Flame Stability with Optimized Electric Field Geometry, The European Combustion Meeting ECM 2007, 2007, Fig. 1, Germany.

(Continued)

*Primary Examiner* — Gregory Huson
*Assistant Examiner* — Nikhil Mashruwala
(74) *Attorney, Agent, or Firm* — Christopher A. Wiklof; Launchpad IP, Inc.

(57) ABSTRACT

An charge element disposed proximate to a combustion reaction is caused to carry a voltage while also being prevented from arc-discharging or arc-charging to or from the combustion reaction, by a current limiting element in electrical continuity with the charge element.

32 Claims, 7 Drawing Sheets

(56) References Cited

U.S. PATENT DOCUMENTS

| | | | | |
|---|---|---|---|---|
| 3,416,870 | A | 12/1968 | Wright | |
| 3,776,684 | A * | 12/1973 | Wright | F23N 5/20 431/66 |
| 3,841,824 | A | 10/1974 | Bethel | |
| 3,941,112 | A * | 3/1976 | Habert | F02P 15/12 123/624 |
| 4,020,388 | A | 4/1977 | Pratt, Jr. | |
| 4,111,636 | A | 9/1978 | Goldberg | |
| 4,591,332 | A | 5/1986 | Wada | |
| 5,088,917 | A | 2/1992 | Leleu et al. | |
| 5,146,907 | A * | 9/1992 | Sawazaki | F02P 3/0552 123/644 |
| 5,199,407 | A * | 4/1993 | Sawazaki | F02P 3/051 123/644 |
| 5,702,244 | A | 12/1997 | Goodson et al. | |
| 5,784,889 | A | 7/1998 | Joos et al. | |
| 6,055,972 | A * | 5/2000 | Fujimoto | G01N 27/4067 123/688 |
| 7,137,808 | B2 | 11/2006 | Branston et al. | |
| 7,243,496 | B2 | 7/2007 | Pavlik et al. | |
| 7,523,603 | B2 | 4/2009 | Hagen et al. | |
| 7,845,937 | B2 | 12/2010 | Hammer et al. | |
| 8,851,882 | B2 | 10/2014 | Hartwick et al. | |
| 8,881,535 | B2 | 11/2014 | Hartwick et al. | |
| 8,911,699 | B2 | 12/2014 | Colannino et al. | |
| 9,151,549 | B2 | 10/2015 | Goodson et al. | |
| 9,209,654 | B2 | 12/2015 | Colannino et al. | |
| 9,377,190 | B2 | 6/2016 | Karkow et al. | |
| 9,388,981 | B2 | 7/2016 | Karkow et al. | |
| 2003/0203245 | A1 | 10/2003 | Dessiatoun et al. | |
| 2005/0208442 | A1 | 9/2005 | Heiligers et al. | |
| 2006/0165555 | A1 | 7/2006 | Spielman et al. | |
| 2007/0020567 | A1 | 1/2007 | Branston et al. | |
| 2010/0000404 | A1 | 1/2010 | Sakuma et al. | |
| 2010/0183424 | A1 | 7/2010 | Roy | |
| 2011/0027734 | A1 | 2/2011 | Hartwick et al. | |
| 2011/0072786 | A1 | 3/2011 | Tokuda et al. | |
| 2011/0203771 | A1 | 8/2011 | Goodson et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |
| 2013/0291552 | A1 | 11/2013 | Smith et al. | |
| 2013/0323655 | A1 | 12/2013 | Krichtafovitch et al. | |
| 2013/0323661 | A1 | 12/2013 | Goodson et al. | |
| 2013/0333279 | A1 | 12/2013 | Osler et al. | |
| 2013/0336352 | A1* | 12/2013 | Colannino | F23C 99/001 373/1 |
| 2014/0038113 | A1 | 2/2014 | Breidenthal et al. | |
| 2014/0051030 | A1 | 2/2014 | Colannino et al. | |
| 2014/0065558 | A1 | 3/2014 | Colannino et al. | |
| 2014/0076212 | A1 | 3/2014 | Goodson et al. | |
| 2014/0080070 | A1 | 3/2014 | Krichtafovitch et al. | |
| 2014/0162195 | A1 | 6/2014 | Lee et al. | |
| 2014/0162196 | A1 | 6/2014 | Krichtafovitch et al. | |
| 2014/0162197 | A1 | 6/2014 | Krichtafovitch et al. | |
| 2014/0162198 | A1 | 6/2014 | Krichtafovitch et al. | |
| 2014/0170569 | A1 | 6/2014 | Anderson et al. | |
| 2014/0170571 | A1 | 6/2014 | Casasanta, III et al. | |
| 2014/0170575 | A1 | 6/2014 | Krichtafovitch | |
| 2014/0170576 | A1 | 6/2014 | Colannino et al. | |
| 2014/0170577 | A1 | 6/2014 | Colannino et al. | |
| 2014/0186778 | A1 | 7/2014 | Colannino et al. | |
| 2014/0196368 | A1 | 7/2014 | Wiklof | |
| 2014/0196369 | A1 | 7/2014 | Wiklof | |
| 2014/0208758 | A1 | 7/2014 | Breidenthal et al. | |
| 2014/0212820 | A1 | 7/2014 | Colannino et al. | |
| 2014/0216401 | A1 | 8/2014 | Colannino et al. | |
| 2014/0227645 | A1 | 8/2014 | Krichtafovitch et al. | |
| 2014/0227646 | A1 | 8/2014 | Krichtafovitch et al. | |
| 2014/0227649 | A1 | 8/2014 | Krichtafovitch et al. | |
| 2014/0234786 | A1 | 8/2014 | Ruiz et al. | |
| 2014/0234789 | A1 | 8/2014 | Ruiz et al. | |
| 2014/0248566 | A1 | 9/2014 | Krichtafovitch et al. | |
| 2014/0251191 | A1 | 9/2014 | Goodson et al. | |
| 2014/0255855 | A1 | 9/2014 | Krichtafovitch | |
| 2014/0255856 | A1 | 9/2014 | Colannino et al. | |
| 2014/0272730 | A1 | 9/2014 | Krichtafovitch et al. | |
| 2014/0272731 | A1 | 9/2014 | Breidenthal et al. | |
| 2014/0287368 | A1 | 9/2014 | Krichtafovitch et al. | |
| 2014/0295094 | A1 | 10/2014 | Casasanta, III | |
| 2014/0295360 | A1 | 10/2014 | Wiklof | |
| 2014/0335460 | A1 | 11/2014 | Wiklof et al. | |
| 2014/0338350 | A1 | 11/2014 | Breidenthal et al. | |
| 2015/0079524 | A1 | 3/2015 | Colannino et al. | |
| 2015/0104748 | A1 | 4/2015 | Dumas et al. | |
| 2015/0107260 | A1 | 4/2015 | Colannino et al. | |
| 2015/0118629 | A1 | 4/2015 | Colannino et al. | |
| 2015/0121890 | A1 | 5/2015 | Colannino et al. | |
| 2015/0140498 | A1 | 5/2015 | Colannino | |
| 2015/0147704 | A1 | 5/2015 | Krichtafovitch et al. | |
| 2015/0147705 | A1 | 5/2015 | Colannino et al. | |
| 2015/0147706 | A1 | 5/2015 | Krichtafovitch et al. | |
| 2015/0219333 | A1 | 8/2015 | Colannino et al. | |
| 2015/0226424 | A1 | 8/2015 | Breidenthal et al. | |
| 2015/0276211 | A1 | 10/2015 | Colannino et al. | |
| 2015/0276217 | A1 | 10/2015 | Karkow et al. | |
| 2015/0276220 | A1 | 10/2015 | Karkow et al. | |
| 2015/0285491 | A1 | 10/2015 | Karkow et al. | |
| 2015/0316261 | A1 | 11/2015 | Karkow et al. | |
| 2015/0330625 | A1 | 11/2015 | Karkow et al. | |
| 2015/0338089 | A1 | 11/2015 | Krichtafovitch et al. | |
| 2015/0345780 | A1 | 12/2015 | Krichtafovitch | |
| 2015/0345781 | A1 | 12/2015 | Krichtafovitch et al. | |
| 2015/0362177 | A1 | 12/2015 | Krichtafovitch et al. | |
| 2015/0362178 | A1 | 12/2015 | Karkow et al. | |
| 2015/0369476 | A1 | 12/2015 | Wiklof | |

FOREIGN PATENT DOCUMENTS

| | | |
|---|---|---|
| EP | 2738460 | 6/2014 |
| GB | 932955 | 7/1963 |
| GB | 1042014 | 9/1966 |
| JP | 60-216111 | 10/1985 |
| JP | 61-265404 | 11/1986 |
| JP | 2001-021110 | 1/2001 |
| WO | WO 96/01394 | 1/1996 |
| WO | WO 2012/109499 | 8/2012 |
| WO | WO 2013/181569 | 12/2013 |
| WO | WO 2015/160830 | 10/2014 |
| WO | WO 2014/197108 | 12/2014 |
| WO | WO 2015/017084 | 2/2015 |
| WO | WO 2015/017087 | 2/2015 |
| WO | WO 2015/038245 | 3/2015 |
| WO | WO 2015/042566 | 3/2015 |
| WO | WO 2015/051136 | 4/2015 |
| WO | WO 2015/051377 | 4/2015 |
| WO | WO 2015/057740 | 4/2015 |
| WO | WO 2015/089306 | 6/2015 |
| WO | WO 2015/103436 | 7/2015 |
| WO | WO 2016/003883 | 1/2016 |

OTHER PUBLICATIONS

PCT International Search Report and Written Opinion of International PCT Application No. PCT/US2013/059061 mailed Dec. 13, 2013.

M. Zake et al., "Electric Field Control of NOx Formation in the Flame Channel Flows." Global Nest: The Int. J. May 2000, vol. 2, No. 1, pp. 99-108.

* cited by examiner

ELECTRODYNAMIC COMBUSTION CONTROL WITH CURRENT LIMITING ELECTRICAL ELEMENT

CROSS-REFERENCE TO RELATED APPLICATIONS

The present application is a U.S. Continuation application which claims priority benefit under 35 U.S.C. §120 (pre-AIA) of co-pending International Patent Application No. PCT/US2013/059061, entitled "ELECTRODYNAMIC COMBUSTION CONTROL WITH CURRENT LIMITING ELECTRICAL ELEMENT", filed Sep. 10, 2013; which application claims priority benefit U.S. Provisional Patent Application No. 61/731,639, entitled "COMBUSTOR ELECTRODE WITH CURRENT LIMITING ELECTRICAL ELEMENT", filed Nov. 30, 2012; and U.S. Provisional Patent Application No. 61/698,820, entitled "COMBUSTION SYSTEM HAVING MULTIPLEXED ELECTRODES WITH ARC SUPPRESSION", filed Sep. 10, 2012; each of which, to the extent not inconsistent with the disclosure herein, is incorporated by reference.

SUMMARY

According to an embodiment, a combustion system includes a charge element configured to be disposed proximate to a combustion reaction, an electrical node configured for electrical continuity with the charge element, and a current limiting element disposed to convey the electrical continuity from the electrical node to the charge element and to limit electrical current flow from the electrical node to the charge element or from the charge element to the electrical node.

According to an embodiment, a method for controlling a combustion reaction includes providing a charge element proximate to a combustion reaction, establishing a voltage on an electrical node, providing electrical continuity between the charge element and the electrical node with a current limiting element, and causing a tangible effect on the combustion reaction with the voltage.

According to an embodiment, a combustion system is provided that includes combustion means configured to support a combustion reaction, charging means configured to apply a charge to the combustion reaction, a power supply configured to supply a voltage difference between the charging means and the combustion reaction, and current limiting means configured to prevent a flow of current between the power supply and the means from exceeding a selected threshold.

According to an embodiment, the current limiting means are electrically coupled between the power supply and the charge element means.

According to another embodiment, the current limiting means are electrically coupled in a current path between the combustion reaction and a circuit ground.

According to an embodiment, the current limiting means are configured to reduce a voltage drop across dielectric gap between the charge element means and the combustion reaction in response to and incipient arc forming across the dielectric gap.

According to an embodiment, the charge element means include charge ejection means.

According to an embodiment, the charge ejection means include a serrated electrode having a plurality of projections, each configured to produce a respective corona discharge.

According to an embodiment, the charge element means include a plurality of charge elements positioned around a space occupied by the combustion means and configured to apply a charge to the combustion reaction.

According to an embodiment, the current limiting means include a plurality of current limiting elements, each configured to prevent a flow of current between the power supply and a respective one of the plurality of charge elements from exceeding a selected threshold.

According to an embodiment, the combustion system includes second charge element means having a plurality of charge elements that are positioned, shaped, and configured to act as a flame anchor and to provide an electrical path for a counter-charge to the combustion reaction.

According to an embodiment, the current limiting means include a plurality of current limiting elements, each configured to prevent a flow of current between a circuit node and a respective one of the plurality of charge elements of the second charge element means from exceeding the selected threshold.

According to an embodiment, the power supply is configured to supply the voltage difference between the charge element means and the circuit node.

DETAILED DESCRIPTION

Figure 1:
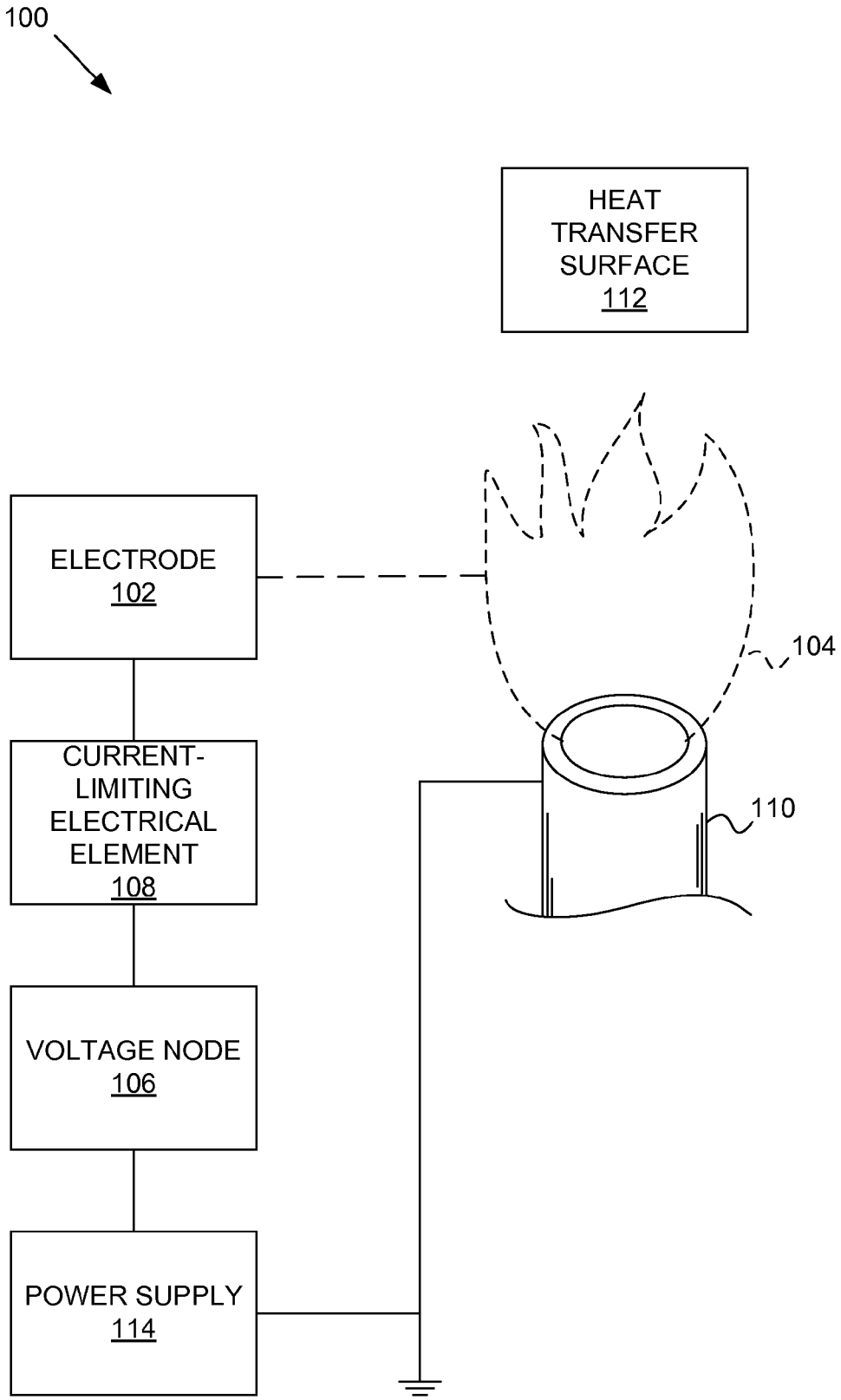
FIG. 1 is a diagram of a combustion system including a charge element operatively coupled to or including a current-limiting element, according to an embodiment.

In the following detailed description, reference is made to the accompanying drawings, which form a part hereof. In the drawings, similar symbols or reference numbers typically identify similar components, unless context dictates otherwise. Where a number of elements in a drawing are indicated with a same reference number followed by different lower-case letters, e.g., 20*a*, 20*b*, 20*c*, etc., this is to enable reference, within the accompanying text, to individual ones of a plurality of substantially similar elements. This is for convenience and clarity of description, only, and such designations, per se, do not affect the scope of the claims.

Electrodynamic Combustion Control (ECC) refers to a combustion system that includes a mechanism for applying electrical energy to a combustion reaction such as, e.g., a flame. ECC can be employed to control or modify any of a number of parameters associated with the combustion reaction, including, for example, flame size, position, temperature, and emissive spectrum, fuel acceptance, combustion efficiency, emission control, etc. The configuration of the ECC system will vary according to the combustion parameter(s) it is designed to control. In some cases, a DC voltage charge is applied to the combustion reaction, while in others, the applied charge has an alternating polarity or a time-varying magnitude. Typically, the applied electrical energy produces charged ions that are carried in a fuel/combustion stream, and that can be electrically manipulated to control the combustion reaction a desired manner. In order to generate charged ions in sufficient quantities, a high-voltage charge is generally applied to the combustion reaction, which can range from below 10 kV to above 100 kV, and as noted, can be in the form of a constant-voltage signal, an oscillating or intermittent signal, etc.

Although the voltage used to apply the electrical charge to the combustion reaction is high, electrical current, if any, is usually very low, because charged ions are produced in a dielectric gap across which the ions travel to impinge on the combustion reaction. The resulting electrical current has a low electron density, which translates into a low amperage value.

In the case of an ECC system, typically, a charge element, such as, e.g., an electrode, is positioned near a combustion reaction within a combustion chamber, and a high voltage potential is applied to the charge element. Charged ions are formed in the dielectric gap surrounding the flame. The atmosphere within a combustion chamber, including the dielectric gap region, generally includes air and flue gas, and is non-conductive, or has a very high electrical resistance. However, conditions within a combustion chamber are subject to change. For example, a flame can suddenly change position, the composition of the atmosphere can vary, and temperatures can rise or fall. Any of these events can change the resistance and breakdown voltage of the dielectric gap. If at any time the voltage difference between the charge element and the flame is greater than the breakdown voltage of the dielectric gap, a conductive path will form between the charge element and a ground source, via the combustion reaction, permitting a spark to form, and to initiate an arc of high current to travel from the charge element to ground.

While such events are not uncommon, and do not normally interfere significantly with operation of an ECC system, the inventors have recognized that a number of benefits can be obtained if such transient sparks are prevented from occurring, or are limited in size and/or frequency. For example, in a system that is subject to periodic high-current discharges, any electrical component through which a discharge passes must be capable of transmitting the discharge without incurring damage. Thus, eliminating or reducing the magnitude of such discharges would permit the use of small or less robust components, which would be damaged or destroyed by high-current discharges and/or increase the life of electrodes that can be pitted or otherwise degraded by high-current discharges. This, in turn, can: (1) reduce the cost of the components, (2) increase the working life of the components, and/or (3) expand the number of options available to a system designer with regard to component and system design.

Another benefit is the reduction of power consumption. The cost of generating a high voltage potential with little or no current consists primarily of the one-time cost of providing the voltage generator. In the case of most ECC systems, absent the arcing and the accompanying current discharge, the power consumed is usually measured in tens of watts, or less. However, during an arcing event, for a brief instant, power in the megawatts range may be consumed. Depending on the frequency of such events, the power consumption and cost can become significant.

Finally, reduction or elimination of current discharge events can enable better system control. For example, depending on the design of the power supply, there may be a number of capacitors in a configuration that enables each to carry a portion of the total voltage charge. At start-up, the capacitors are charged in sequence, during successive cycles of an oscillating supply voltage. The full output voltage of the power supply is only achieved when all of the capacitors are charged, after several cycles of the supply voltage. During a current discharge event, some or all of those capacitors may be drained, meaning that, immediately thereafter, no charge can be applied to the flame until the capacitors are recharged. Thus, in some system designs, there may be a momentary loss of flame control while the voltage supply recovers from the discharge. Such momentary loss of control can have a significant impact on operation of the combustion system. For example, one use of ECC is to anchor a flame to a flame holder. When a charge is applied to the flame via a charge element and a counter charge is applied to the flame holder, the flame can be made to anchor to the flame holder, even when a fuel stream is emitted from a fuel nozzle at speeds that far exceed the normal flame propagation speed. If the applied charge is lost, the flame can instantly move away from the flame holder and may become unstable, or even be extinguished. Under such conditions, once the power supply recovers, it may be necessary to execute a restart procedure, which may involve purging the system of un-burnt fuel, repositioning heat transfer surfaces, etc.

Clearly, reduction or elimination of discharge events and the corresponding increase in continuity of flame control would have a positive effect on operation of the overall system.

The benefits and advantages outlined above are examples, only. As suggested, the obtainable benefits will depend upon the particular design of a given system, and may or may not include those outlined above.

FIG. 1 is a diagram of a combustion system 100 according to an embodiment, including a charge element 102 operatively coupled to or including a current-limiting element 104 configured to limit electrical current passing therethrough. An electrical node 106 is electrically coupled with the charge element 102 through the current limiting element 104. The current limiting element 108 is configured to limit current flow from the electrical node 106 to the charge element 102 or from the charge element 102 to the electrical node 106. The combustion system 100 includes a fuel nozzle 110 configured to provide fuel to the combustion reaction 104. Optionally, the fuel nozzle 110 may be configured as a charge element 102. In the embodiment shown, a power supply 114 is coupled to the electrical node 106 to provide power to the system 100.

A heat transfer surface 112 is configured to receive heat from the combustion reaction 104. According to various embodiments, the combustion system 100 may include, for example, a propulsion system, a chemical process, or an electrical generation system, operatively coupled to the heat transfer surface 112.

According to an embodiment, the charge element 102 is configured to apply an electric field to the combustion reaction 104. The charge element 102 may additionally or alternatively be configured to apply charges to the combustion reaction 104. The charge element 102 may additionally or alternatively be configured to apply a voltage to the combustion reaction 104.

Under certain conditions, the charge element 102 is subject to creating an electrical arc with the combustion reaction 104. The current limiting element 108 is configured to substantially prevent or significantly limit the formation of an electrical arc.

Figure 2:
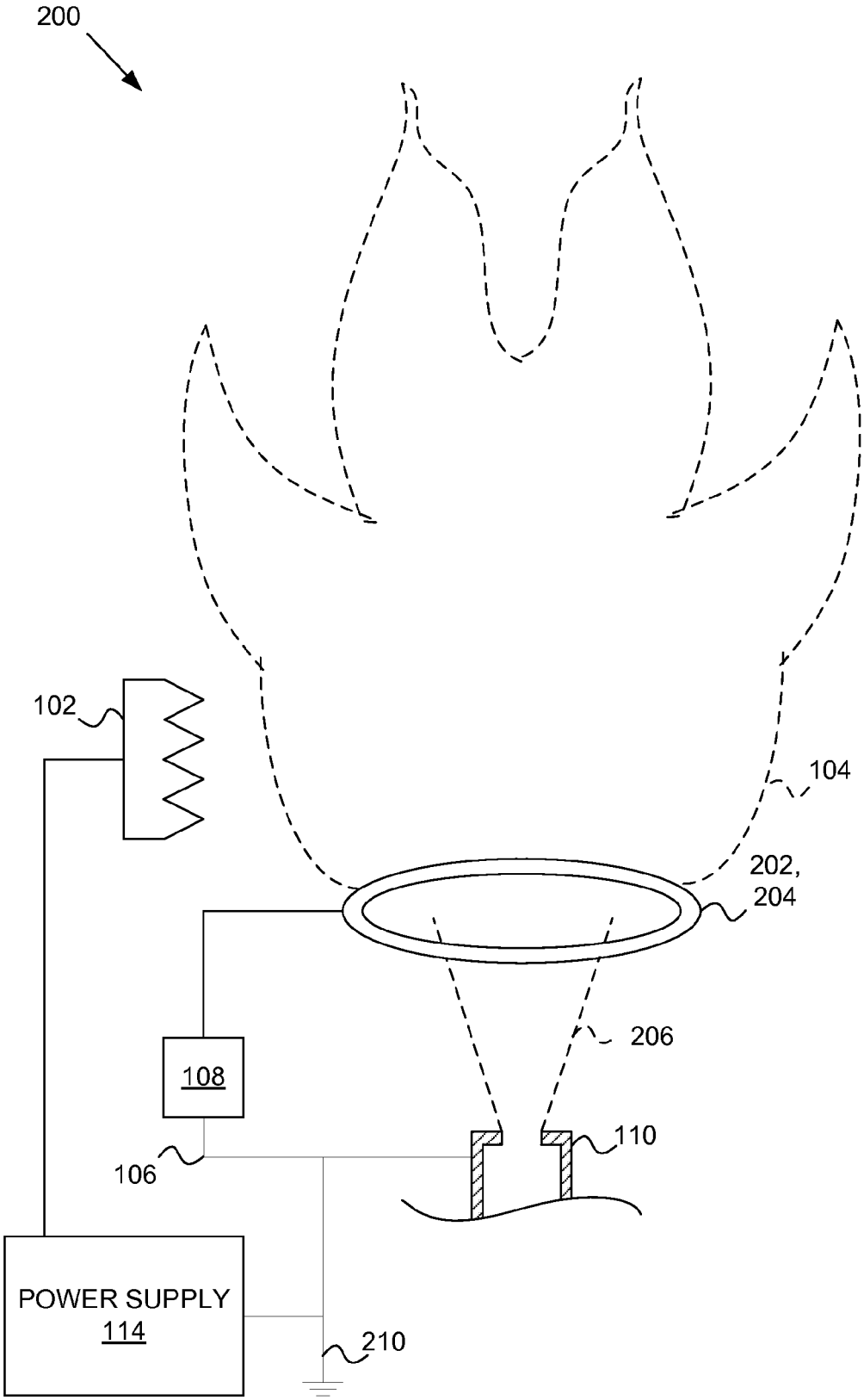
FIG. 2 is a diagram of a combustion system including a charge element configured as a combustion reaction support surface, according to an embodiment.

FIG. 2 is a diagram of a combustion system 200 including a second charge element 202 configured, in this embodiment, to include a combustion reaction support surface 204. In embodiments in which the combustion reaction 104 includes a flame, the combustion reaction support surface 204 may be referred to as a flame holder, as explained in more detail below. A first charge element 102 is configured to apply a charge or voltage to the combustion reaction 104, while the second charge element 202 is configured to provide a path to voltage ground from the combustion reaction 104. The combustion reaction support surface 204 is disposed peripherally to a fuel stream or jet 206. For example, the combustion reaction support surface 204 may be disposed peripheral to and separated from the fuel stream 206. Alternatively, the combustion reaction support surface 204 may be disposed peripheral and adjacent to the fuel stream 206. The combustion system 200 also includes a power supply 114, configured to establish a high-voltage potential between the first and second charge elements 102, 202. In the embodiment of FIG. 2, the current limiting element 108 is positioned in the electrical path between the charge element 202 and a circuit ground 210. According to other embodiments, the current limiting element 108 can be positioned in the electrical path between the power supply 114 and the charge element 102. In either case, any electrical circuit formed through the combustion reaction 104 also passes through the current limiting element 108. Use of the term charge element in the specification or claims is to be construed as including within its scope any element positioned and configured to apply electrical energy, such as a charge, a voltage, an electric field, etc., to a combustion reaction, unless explicitly indicated otherwise. Examples of charge elements include corona discharge electrodes, dull electrodes, counter electrodes, field grids, etc.

Flame holders are widely used in combustion systems to stabilize a flame. Particularly in systems in which a stream of combustion fluids, including fuel and oxidizer, is introduced into a combustion volume or chamber at a speed that exceeds the flame propagation speed, a flame holder is provided to prevent the flame from being lifted from an optimal position within the combustion volume, or from being extinguished. A typical flame holder includes an element that introduces turbulence into the stream of combustion fluids that results in a protected space where the fluid stream is slowed sufficiently to support a flame. Based on experiments conducted by the inventors and others, a charge element positioned near a fuel nozzle and coupled in an ECC circuit can be made to anchor a flame, even in the absence of the turbulence associated with traditional flame holders. Thus, as used herein, the term flame holder also includes within its scope such electrically driven devices.

According to an embodiment, the combustion reaction 104 is driven to a majority charge or a flame voltage having a first polarity, by application, for example, of a high voltage charge via the charge element 102. The electrical node 106 is held at a voltage opposite in polarity from the majority charge or flame voltage, or is held at a voltage ground. The combustion reaction 104 anchors to the combustion reaction support surface 204 responsive to a current flow between the combustion reaction 104 and the charge element/support surface 202, 204.

The current limiting element 108 may be configured to maintain an electrical potential between the electrical node 106 and the combustion reaction 104. For example, the current limiting element 108 may cause the charge element 202 to float to an electrical potential between an electrical potential of the combustion reaction 104 and the electrical potential of the electrical node 106. The combustion reaction 104 may be caused to maintain contact with the charge element/support surface 202, 204 responsive to current limiting provided by the current limiting element 108.

Figure 3:
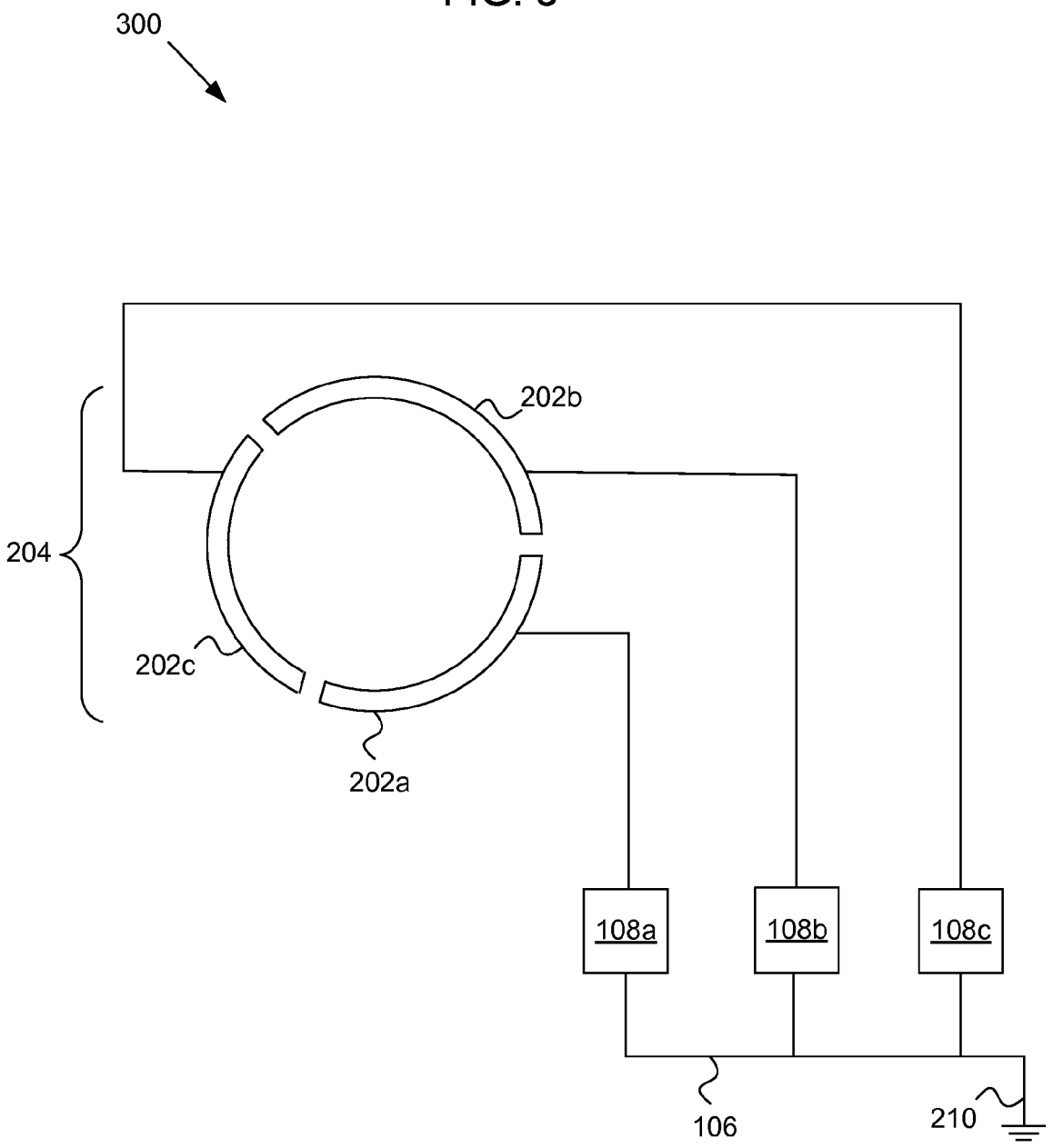
FIG. 3 is a diagram of a combustion support surface formed as a plurality of electrode segments, according to an embodiment.

FIG. 3 is a diagram showing a portion of a combustion system 300 that includes a combustion reaction support surface 204 formed as a plurality of electrode segments 202*a*, 202*b* and 202*c*, according to an embodiment. The current limiting element 108 includes a corresponding plurality of current limiting elements 108*a*, 108*b* and 108*c*. Each of the plurality of current limiting elements 108 is configured to convey current between the respective one of the plurality of electrode segments 202 and the electrical node 106 while limiting electrical current passing therethrough.

During operation, a spark or an incipient electrical arc forming between the combustion reaction 104 and one of the plurality of electrode segments 202*a*, for example, is stopped or limited by the current limit provided by the corresponding one of the plurality of current limiting elements 108*a*. Electrical arcs tend to require relatively high current to form or persist. By limiting the current available at one end of the arc (e.g., the electrode segment 202*a*), the arc is unable to fully form because a voltage sag or a shutting off of the current responsive to the beginning of arc formation causes the arc to collapse. Meanwhile, the remaining ones of the plurality of electrode segments 202*b*, 202*c* continue to function as normal, so that a high-voltage potential remains between the combustion reaction 104 and the remaining electrode segments 202*b*, 202*c*. In this way, electrodynamic combustion control is maintained, while undesirable discharge events are reduced or prevented.

According to some embodiments that include plural electrode segments 202 and corresponding plural current limiting elements 108, the plurality of current limiting elements 108 is configured to collectively convey current between the electrical node 106 and the plurality of charge elements 202 in excess of an amount of current carried by an electrical arc, even though the individual ones of the current limiting elements 108 are each configured to admit a maximum current that is below a current level necessary to support an electrical arc. Thus, there is a very high limit to the collective current carrying capacity of a plurality of charge elements such as the electrode segments 202 even when the current carrying capacity of a single electrode segment 202 is limited.

According to an embodiment, the current limiting element 108 includes a linear current limiting component. For example, the current limiting element 108 may include an electrical resistor. According to another embodiment, the current limiting element 108 includes a nonlinear current limiting electrical component. For example, the current limiting element 108 may include a mechanical switch or an electronic switch, such as, e.g., a transistor.

According to an embodiment, either of the charge elements 102, 202 and the current limiting element 108 may be integrated. For example, according to some embodiments, the current limiting element 108 and/or one of the charge elements 102, 202 are formed as a single component that serves both functions.

According to another embodiment, the current limiting element 108 is integrated with the power supply 114 into a single component, in which case, outputs from the power supply 114 are current-limited.

According to various embodiments, components of an ECC system are formed at least in part of semiconductor material or in a semiconductor material substrate. For example, either or both of the charge elements 102, 202 can be formed of a semiconductor material, such as silicon and/or germanium. Likewise, elements of the power supply 114 and/or the current limiting element 108 can be formed of or on a semiconductor material substrate.

According to another embodiment, the power supply 114 is configured to drive the electrical node 106 in addition to, or instead of the charge element 102.

Figure 4:
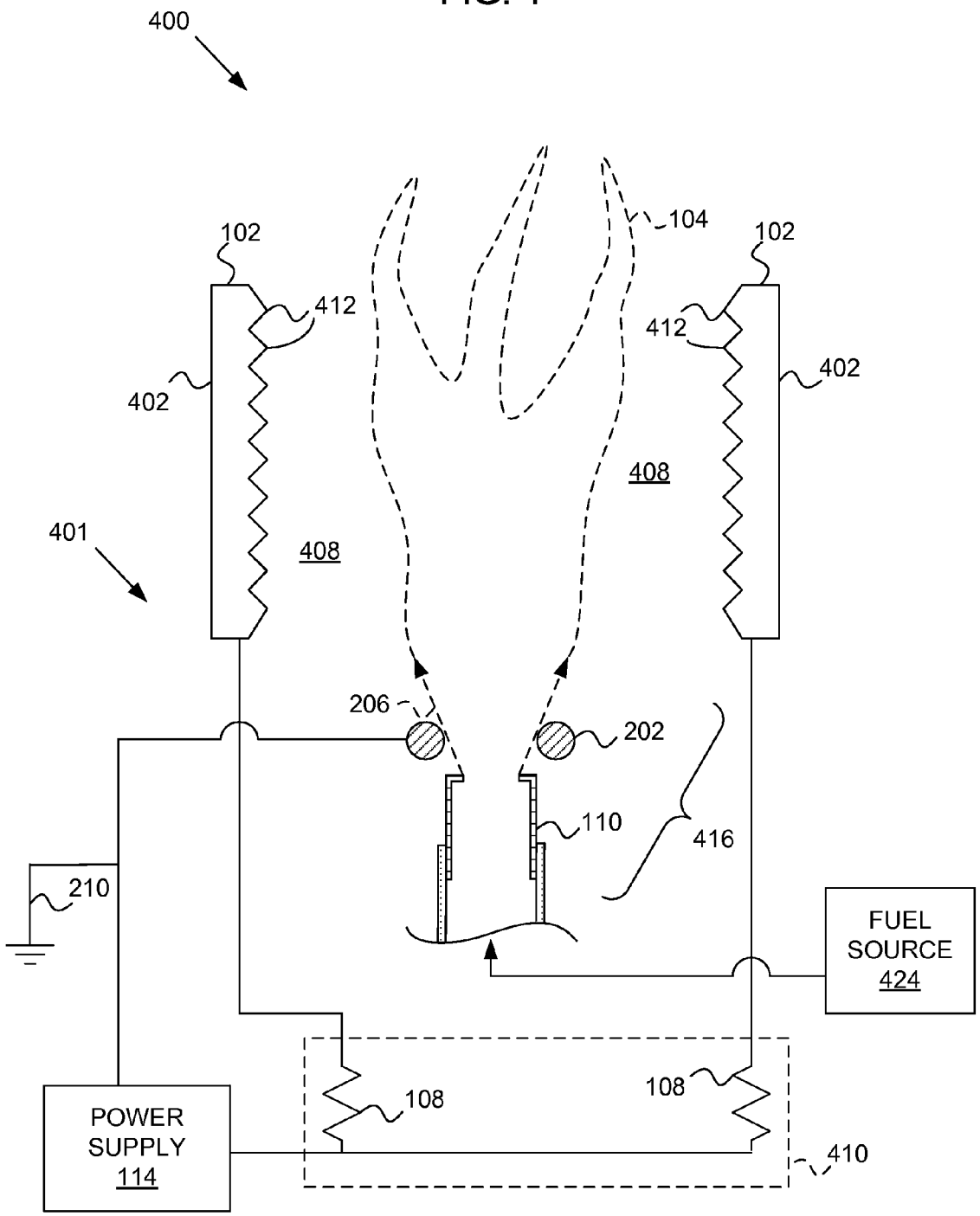
FIG. 4 is a diagram of a combustion system including a plurality of corona electrodes coupled to respective elements of a current limiting device, according to an embodiment.

FIG. 4 is a diagram showing a combustion system 400, according to an embodiment, which includes an ECC system 401 for applying a charge to a combustion reaction 104. The ECC system 401 includes a power supply 114 that is configured to output a voltage of 1000 volts or more. According to various embodiments, the power supply 114 may be configured to output a voltage of more than 50-100 kV. A plurality of charge elements 102 is operatively coupled to the power supply 114 and configured to provide electrical energy, such as, e.g., a voltage potential, an electrical field, or charged ions to the combustion reaction 104 or to a region 408 proximate the combustion reaction 104. A charge element multiplexer 410 is operatively coupled between the power supply 114 and the plurality of charge elements 102 and is configured to substantially prevent an electrical arc from forming between any of the plurality of charge elements 102 and the combustion reaction 104.

According to an embodiment, each of the plurality of charge elements 102 includes a serrated electrode 402, each having a plurality of projections 412 shaped to facilitate ion ejection into the region 408 responsive to receiving voltage from the power supply 114.

The serrated electrodes 402 are examples of corona electrodes, configured to eject charged ions into the region 408. The region 408 is sometimes referred to as a dielectric gap. The dielectric gap may contain air and/or flue gas, for example, and has, typically, a high dielectric value.

The charge element multiplexer 410 is configured to limit current flow through any of the plurality of charge elements 102 when, for example, the combustion reaction 104 traverses the dielectric gap 408 to one of the plurality of charge elements 102 and/or when a spark or arc begins to form between one of the plurality of charge elements 102 and the combustion reaction 104.

The charge element multiplexer 410 includes a plurality of current limiting elements 108, each operatively coupled to a corresponding one of the plurality of charge elements 102. In the embodiment shown in FIG. 4, each of the plurality of current limiting elements 108 includes an electrically linear current limiting element, such as a resistor, for example. Additionally or alternatively, each of the plurality of current limiting elements 108 can include one or more electrically nonlinear current limiting elements, such as varistors, amplifiers, comparators, and/or switches, for example. The plurality of current limiting elements 108 may include active devices and/or passive devices. The plurality of current limiting elements 108 may include discrete devices and/or integrated devices. According to an embodiment, the plurality of current limiting elements 108 includes semiconductor devices. According to various embodiments, each of the plurality of current limiting elements 108 includes one or more sensors configured to detect a surge in current, and one or more programmable devices configured to respond to the corresponding sensor(s).

According to an illustrative embodiment, each of the plurality of current limiting elements includes a resistor selected to cause voltage across the respective charge element 102 to sag as current passing through the charge element 102 increases beyond a selected value.

According to an embodiment, the combustion system 400 includes a fuel burner structure 416 that is configured to support the combustion reaction 104. According to an embodiment, the ECC system 401 includes a counter charge element 202 configured to at least intermittently transmit current between the combustion reaction 104 and a circuit ground 210 responsive to ions ejected by the plurality of charge elements 102. The value of the current transmitted by the counter charge element 202 is selected to anchor the combustion reaction 104 proximate to the counter electrode 202. The combustion system 400 may include a conductive fuel nozzle tip 110 that is electrically coupled to ground. According to an embodiment, the conductive fuel nozzle tip 110 acts as a counter electrode.

According to an embodiment, the counter electrode 202 includes a toric structure held circumferential to a fuel stream or jet 206 output by a fuel source 424.

According to tests conducted by the inventors, it has been found that an inside diameter of a toric counter charge element 202 can be made significantly larger than the diameter of the fuel jet 206 at the corresponding position, and the counter charge element 202 can still anchor the combustion reaction 104.

Figure 5:
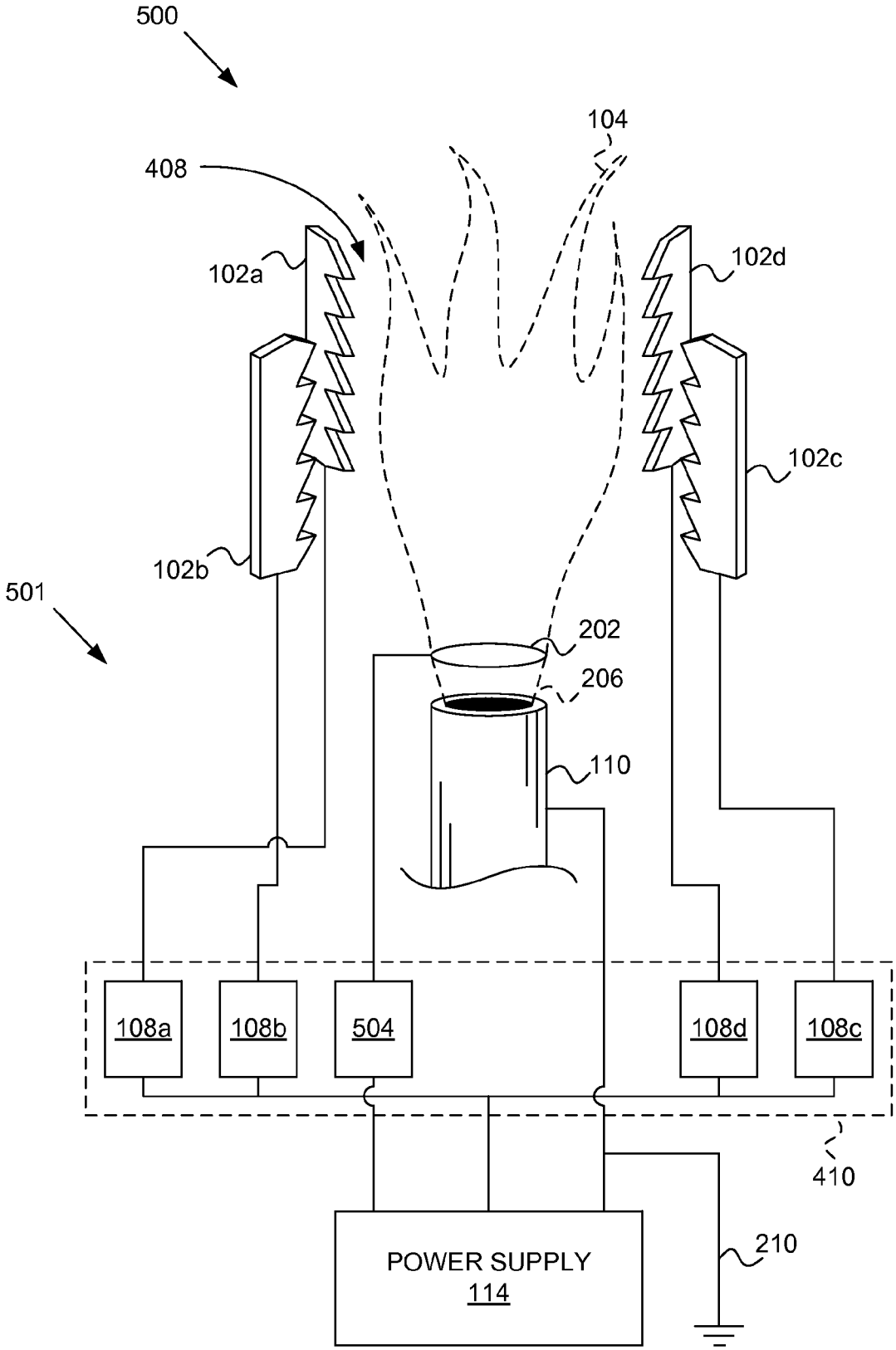
FIG. 5 is a diagram of a combustion system including a plurality of corona electrodes and a flame support element, each coupled to a respective element of a current limiting device, according to an embodiment.

FIG. 5 is a diagram of a combustion system 500 including an ECC system 501, according to an embodiment. The ECC system 501 includes a plurality of charge elements 102. As shown in FIG. 5, the ECC system 501 includes four charge elements 102*a*, 102*b*, 102*c*, and 102*d*, shown in the drawing as serrated corona electrodes 402. However, this is merely provided as an example, inasmuch as the actual number and design of charge elements is a matter of design choice. The inventors have determined that the charge element multiplexer 410 can be more effective at suppressing arcing if there are more than two charge elements 102 and corresponding current limiting elements 108. A greater number of charge elements 102 allow the current limiting elements 108 to more effectively limit current without suppressing normal operation of the system. The minimum value at which current can be limited is inversely proportional to the number of charge elements 102.

The combustion system 500 also includes a flame holding charge element 202 that is configured to transmit current between the combustion reaction 104 and the voltage supply 108 and/or the circuit ground 210. The value of the transmitted current is selected to be sufficient to anchor the combustion reaction 104 to the flame holding charge element 202.

Whether the charge element 202 receives or supplies current to the combustion reaction 104 depends on whether the charge elements 102 are driven positive or negative. For a combustion system 200 where the power supply 108 drives the charge elements 102 with an AC voltage, for example, the flame holding electrode 202 will periodically switch between receiving and supplying current to the combustion reaction 104. In other words, the direction of current flow in the circuit will alternate in accordance with the polarity of the power supply voltage.

The combustion system 500 may also include a current transmission device 504 operatively coupled between the flame holding charge element 202 and the power supply 108 or between the flame holding charge element 202 and a voltage ground 210.

According to the embodiment illustrated in FIG. 5, the charge element multiplexer 410 includes a plurality of current limiting elements 108*a*, 108*b*, 108*c*, and 108*d* operatively coupled to corresponding ones of the plurality of charge elements 102*a-d*. Each of the plurality of current limiting elements 108 is configured to have a current capacity that is substantially equal to a current capacity of the current transmission device 504 divided by the number of charge elements 102 and corresponding current limiting elements 108. Thus, assuming that a voltage potential within the combustion reaction is substantially consistent throughout, when each of the charge elements 102 is conducting current, the amperage through each of the current limiting elements 108 will be substantially identical, and equal to one quarter of the total amperage through the current transmission device 504. At the same time, the voltage drop across each of the current limiting elements 108 and across the current transmission device 504 will be equal.

According to one embodiment, the current transmission device 504 includes a resistor having a first resistance $R_1$. Each of the plurality of current limiting elements 108 includes a respective resistor having a second resistance value $R_2$ about equal to the resistance $R_1$ times the number of current limiting elements 108. The plurality of charge elements 102 and their respective current limiting elements 108 operate in the ECC system 501 substantially as parallel-connected elements. The total value of a plurality of equally sized resistors connected in parallel can be calculated by dividing the sum of their resistances by the number of resistors. Thus, if each of the plurality of current limiting elements 108 has a resistance $R_2$ that is equal to the first resistance $R_1$ multiplied by the number of elements, the collective resistance of the plurality of current limiting elements 108 is effectively equal to the value of the first resistance $R_1$, which is series-coupled in the same circuit. The combined total resistance is therefore equal to about $2R_1$.

During normal operation of the ECC system 501, the combined electrical resistance of the dielectric region 408 and the combustion reaction 104 may be on the order of around 20MΩ. Thus, even assuming, as a hypothetical example, a resistance $R_1$ on the order of 1MΩ, more than 90% of the voltage applied is dropped across the dielectric region 408 and the combustion reaction 104. Accordingly, during normal operation, the effect of the current transmission device 504 and the current limiting elements 108 in the electrical circuit is minor.

Given, for example, a resistance $R_1$ of about 1MΩ, a resistance $R_2$ of about 4MΩ, and a voltage of about 20 kV, normal current in the system 501 would be about 100 μA, with a power consumption of about 18 watts.

On the other hand, if the breakdown voltage of the dielectric region 408 is achieved, an arc begins to form between, for example, the charge element 102*a* and the combustion reaction 104. During formation of the arc, resistance of the dielectric region 408 and the combustion reaction 104 effectively drops to near zero. Because the current discharge travels in an arc rather than in a dispersed field, the current discharge passes only through the single current limiting element 108*a*, coupled to the charge element 102*a*, and therefore "sees" a resistance of 5MΩ, which is the sum of the resistances of the current limiting element 108*a* (4MΩ) and the current transmission device 504 (1MΩ), rather than the resistance of the plurality of current limiting elements 108 in parallel. As the electrical arc causes the resistance of the dielectric gap 408 to drop to near zero, the remaining resistance in the circuit formed by the arc multiplies by 2½, relative to the total resistance during normal operation. The current in the discharge path is thus limited to about 4 mA. More importantly, virtually all of the 20 KV in the circuit is dropped across the 5MΩ series resistance of the one of the plurality of current limiting elements 108*a* and the current transmission device 504. With little or none of the voltage remaining across the dielectric gap 408, there is insufficient energy to maintain the arc, and the discharge path collapses.

In actual practice, although very fast, the shift of the voltage drop from across the dielectric gap 408 to across the resistances $R_1$ and $R_2$ is not instantaneous, but begins to occur as a spark begins to form across the gap, and substantially prevents the current discharge from occurring. As the spark begins to form, effective resistance of the combustion reaction 104 and dielectric region 408 begin to diminish very quickly. Voltage is divided in a circuit according to the relative proportions of resistors in the circuit. Therefore, as the effective resistance of the combustion reaction 104 and dielectric region 408 goes down, more and more of the voltage drop occurs across the resistors $R_1$ and $R_2$. This robs the spark of the voltage pressure it requires to fully develop, interrupting formation of the arc before a discharge event can occur.

According to an embodiment, the current transmission device 504 includes a total current sensor. Each of the plurality of current limiting elements 108 includes a channel current sensor and a corresponding switch configured to limit current to an amperage substantially equal to a current measured by the total current sensor divided by the number of current limiting elements 108.

In experiments conducted by the inventors, it was found that, in a system including eight serrated electrodes 402 nominally energized at 20 kV to 40 kV, arcing between the serrated electrodes 402 and the combustion reaction 104 was substantially eliminated by inserting a resistor of 6MΩ to 7MΩ between the power supply 114 and each of the serrated electrodes 402. In other experiments, the inventors drove the charge elements to about 40 kV while substantially eliminating arcing.

The charge element multiplexing approach described above may also be used to reduce arcing and thereby improve contact between a combustion reaction 104 and a flame holding electrode segment 202.

According to another embodiment, each of the plurality of current limiting elements 108 includes a current-controlled switch configured to open when a level of current through the switch exceeds a selected threshold. In contrast with embodiments employing resistors as current limiting elements, current-controlled switches can be made to have a negligible resistance while conducting. Thus, no additional resistance is introduced into the circuit during normal operation, but when current through a particular switch exceeds the selected threshold, that switch instantly opens, breaking its portion of the circuit, and preventing a possible discharge event.

The current-controlled switches can be any of a number of types of switches, including, for example, semiconductor-based switches, blade switches, solenoid-controlled switches, etc. Semiconductor-based switches can be formed on a semiconductor substrate and can incorporate active semiconductor devices, such as transistors, for example, and can be configured so that a rise in current causes a shut-down bias to be applied to a control terminal of a transistor. Depending on the design of the transistor, and of the associated integrated circuit, the transistor switch can be made to open gradually as current increases, which will have the effect of introducing an increasing resistance, according to the current level. Alternatively, the transistor can be configured to remain in a fully conducting state until the current reaches the selected threshold, whereupon the transistor is turned off, effectively breaking the current path.

There is a wide variety of known mechanically based current-controlled switches and switch assemblies that can function as current limiting elements, and that can be incorporated into respective embodiments. For example, a solenoid-operated switch can be arranged so that the combustion control includes the solenoid coil. At low current levels, such as during normal system operation, the current flows easily through the solenoid coil, generating very small amounts of magnetic flux. As current increases, the magnetic flux produced by the coil also increases. When the magnetic force produced is sufficient to overcome a spring element, the switch is moved to an open, or non-conducting condition, breaking the circuit. Of course, as soon as the switch is actuated and the circuit broken, the current will drop to zero, allowing the switch to reclose, and normal operation to continue.

Switches can be configured to reclose immediately (since the current will have dropped to zero as soon as the switch opens), or a selected delay can be incorporated. A preset delay may be advantageous, particularly in some semiconductor-based circuits that employ extremely fast switches, inasmuch as it may be possible for a switch to reclose before a current discharge event has fully terminated. If the conditions persist that prompted the event in the first place, reclosing a switch prematurely may reinitiate the event. With a preset delay, a switch opens when a current threshold is met or exceeded, then remains open for the selected delay, which may be no more than a few milliseconds. After the delay period, the switch automatically recloses.

Figure 6:
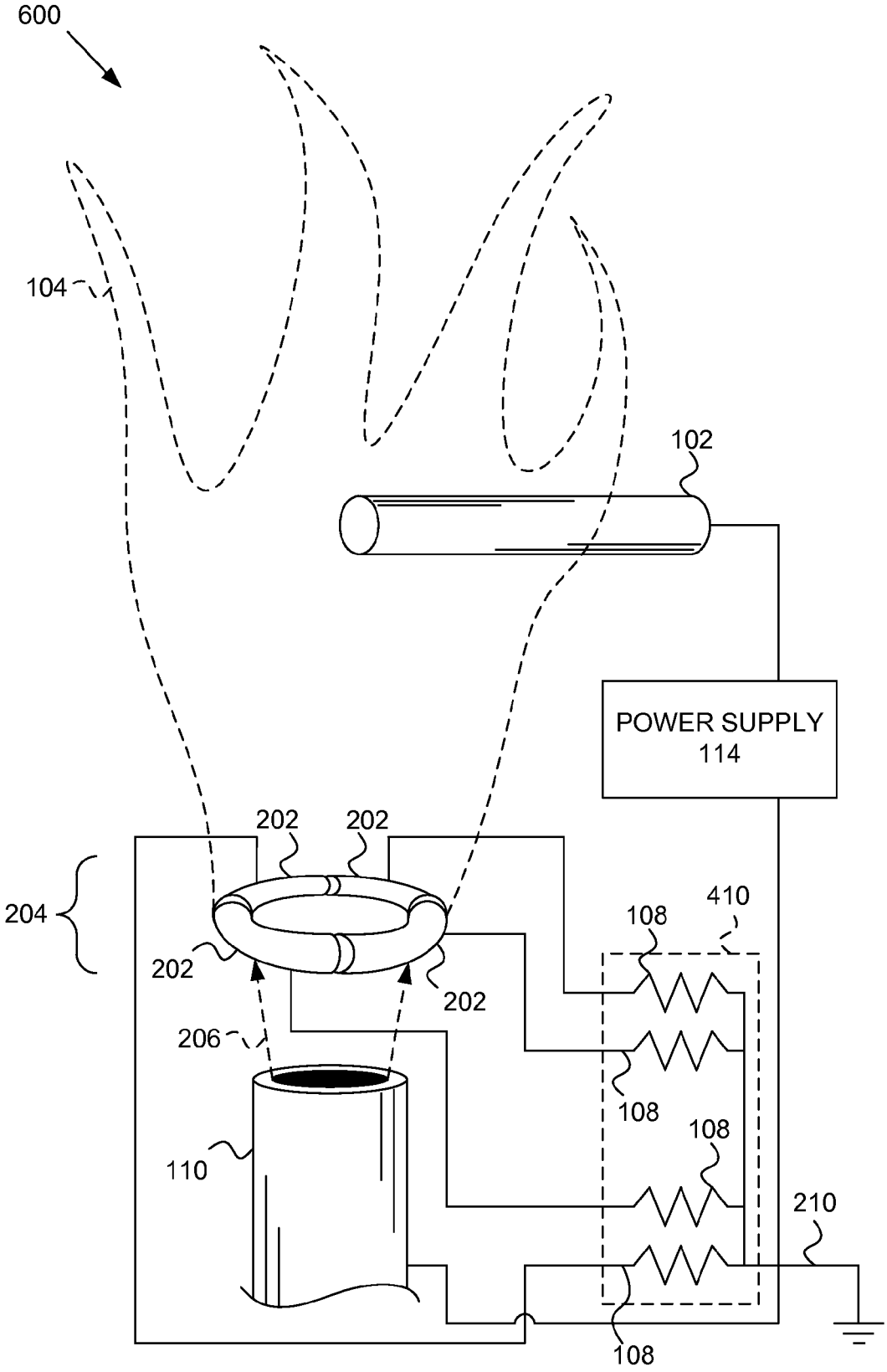
FIG. 6 is a diagram of a combustion system including a charge element and a plurality of flame support elements, each coupled to a respective element of a current limiting device, according to an embodiment.

Although many mechanically-based switches are sufficiently fast to be used, most are not fast enough that an additional delayed reset would be necessary. FIG. 6 is a diagram of a combustion system 600 configured for enhanced flame holding, according to an embodiment. The combustion system 600 includes at least one charge element 102 (such as a corona electrode, for example) configured to apply a charge or voltage to a combustion reaction 104. A charge element configured as a segmented flame holder 204 is configured to anchor the combustion reaction 104. The segmented flame holder 204 includes a plurality of electrode segments 202. The combustion system 600 also includes a charge element multiplexer 410. The charge element multiplexer 410 includes a plurality of current limiting elements 108 operatively coupled between respective segments of the segmented flame holder 204 and an electrical node 210 such as a voltage ground. Each current limiting element 108 is operatively coupled between a corresponding one of the plurality of electrode segments 202 and the electrical node 210. The electrical node 210 may additionally or alternatively include an output from a power supply 114. For example, complementary signals may be provided to the charge element 102 and the electrical node 210. The complementary signals may, for example, include an AC voltage selected to cause current flow to and from the flame holder 204.

The charge element multiplexer 410 and the segmented flame holder 204 are configured to cooperate to maintain contact between the combustion reaction 104 and the segmented flame holder 204. In addition, the segmented flame holder 204 is supported adjacent to the fuel jet 206.

According to an embodiment, the system 300 includes a conductive fuel nozzle tip 110. The conductive fuel nozzle tip 110 may be operatively coupled to the voltage ground 210.

The system 600 may also include the power supply 108. The power supply 114 is configured to apply a voltage to the charge element 102. Optionally, the charge element 102 may include a plurality of charge elements operatively coupled to the power supply 114 via a charge element multiplexer 410, substantially as described with reference to FIG. 4, with the segmented charge element 204 operatively coupled to the electrical node 210 via another voltage multiplexer 410.

The electrode segments 202 are electrically isolated from one another and may be formed of physically separate conductors. The flame holder electrode segments 202 may additionally or alternatively be supported by a common substrate.

Figure 7:
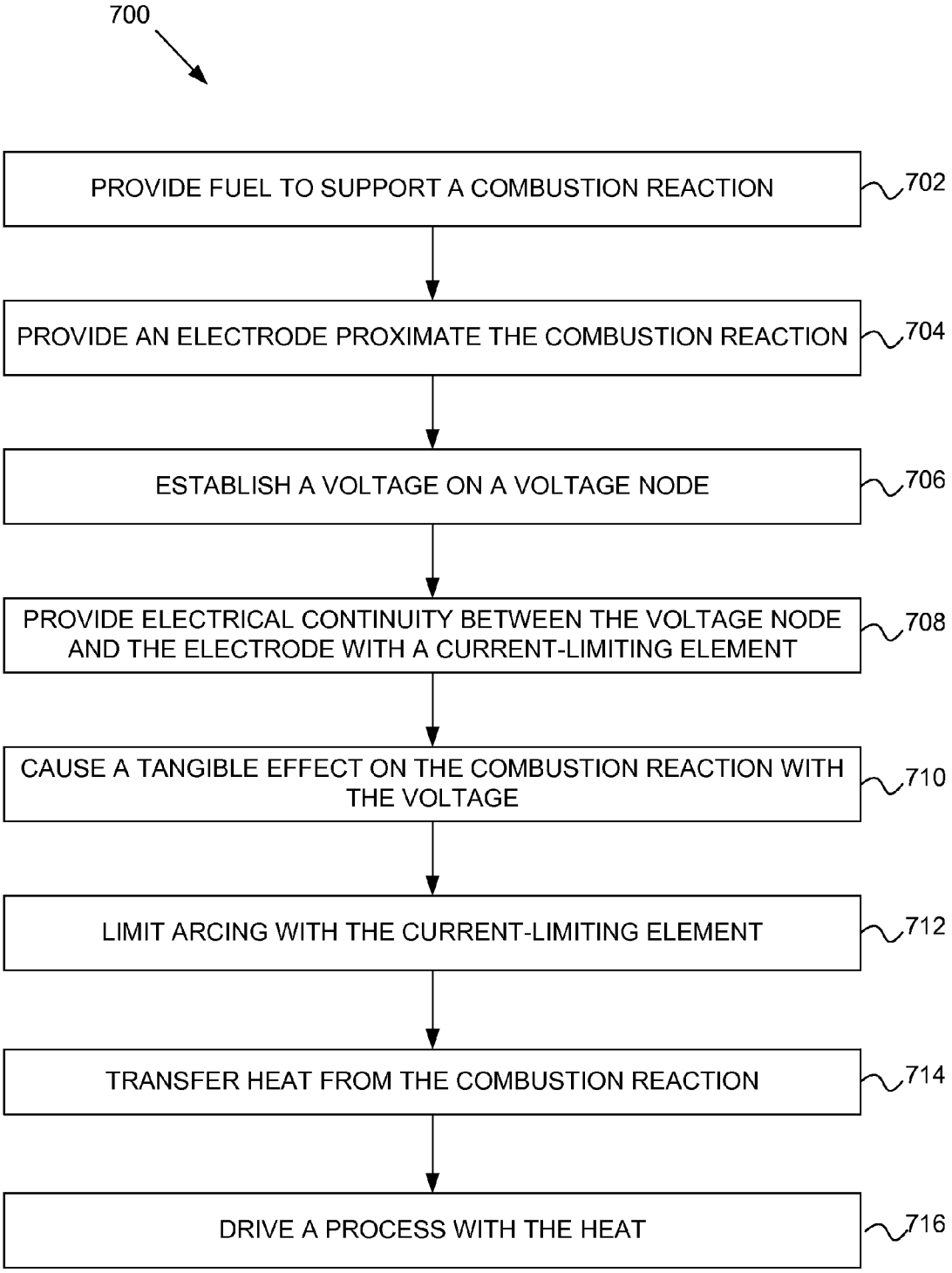
FIG. 7 is a flowchart showing a method for controlling a combustion reaction, according to an embodiment.

FIG. 7 is a flow chart of a method 700 for controlling a combustion reaction, according to an embodiment. Fuel is provided to support the combustion reaction in step 702.

In step 704, a charge element is provided proximate to a combustion reaction. Providing a charge element proximate to a combustion reaction may include providing a plurality of charge elements. According to one embodiment, providing a charge element proximate to the combustion reaction includes providing a plurality of charge element segments of a combustion support surface. According to another embodiment, providing a charge element proximate to the combustion reaction includes providing one or more field (e.g., "dull") electrodes and/or one or more charge ejecting (e.g. "corona," or "sharp") electrodes, configured to eject charged ions. According to an embodiment, providing a charge element proximate to the combustion reaction includes providing a plurality of corona charge elements proximate to the flame and separated from the flame by a dielectric gap. The dielectric gap may include air and/or may include flue gas. The plurality of corona electrodes may include a plurality of serrated electrodes. The serrated electrode includes an electrode body and a plurality of projections. The electrode body and the plurality of projections may be coupled to the electrode body, or may be intrinsic to, i.e., integral parts of the electrode body. Each of the plurality of projections of a serrated electrode is shaped to cause corona ejection of ions responsive to the applied voltage. For example, FIGS. 2, 4, and 5 each show one or more serrated electrodes that include respective pluralities of projections, configured as ion ejecting electrode elements.

In step 706 a voltage is established on an electrical node. For example, the electrical node may include a ground node. In another embodiment, the voltage established on the electrical node includes a substantially constant (DC) voltage other than ground. In another embodiment, establishing a voltage on the electrical node includes establishing a time-varying voltage. For example, a time-varying voltage may include a chopped DC waveform or an alternating-sign (AC) voltage. Establishing a voltage on the electrical node may include establishing an AC voltage superimposed over a DC bias voltage. Other voltage waveforms that may be established on the electrical node include sinusoidal, square, sawtooth, truncated sawtooth, triangular, truncated triangular, and/or other waveforms or combinations thereof selected to produce a tangible effect on the combustion reaction.

Establishing a voltage on the electrical node in step 706 may include driving the electrical node to a voltage with a power supply. Step 706 may include driving the electrical node to a high voltage. In an embodiment, the high voltage on the electrical node has an absolute value of more than 1000 volts. According to an embodiment, the high voltage has an absolute value equal to or greater than 10,000 volts. Alternatively, establishing a voltage on the electrical node in step 706 may include holding the electrical node at a voltage ground. The voltage ground may be maintained by the power supply or may be independent of the power supply.

Proceeding to step 708, electrical continuity is provided between the charge element and the electrical node with a current limiting element. Providing electrical continuity between the charge element and the electrical node may include providing continuity via a linear current limiting element such as an electrical resistor, for example. In another embodiment, electrical continuity is provided between the charge element and the electrical node via a nonlinear current limiting element. For example, the electrical continuity may be provided by a varistor, a semiconductor-based switch, or a transistor operating as the current limiting element.

According to an embodiment, electrical continuity between the charge element and the electrical node is provided via a current limiting element that is integrated with the charge element. For example, the current limiting element may include a semiconductor that forms at least a portion of the charge element. The semiconductor may include silicon and/or germanium, for example. According to an embodiment, the method 700 for controlling a combustion reaction includes providing a power supply to drive the electrical node. The current limiting element may be integrated with the power supply.

According to an embodiment, providing electrical continuity between the charge element and the electrical node with a current limiting element includes providing electrical continuity to a plurality of charge element segments with a corresponding plurality of current limiting elements to convey current between the electrical node and the plurality of charge element segments. Additionally or alternatively, the electrical continuity provided between the charge element and the electrical node with a current limiting element may include providing electrical continuity between the plurality of charge elements and the electrical node with corresponding plurality of current limiting elements.

The method 700 for controlling a combustion reaction may include applying one or more voltages to the charge element to accomplish various effects. For example, the charge element may be configured to apply charges or voltage to the combustion reaction. According to some embodiments, the method 700 for controlling a combustion reaction includes applying a charge or voltage to the combustion reaction from a second charge element and may include providing a path between voltage ground and the combustion reaction via the charge element and the current limiting element.

Proceeding to step 710, a tangible effect is caused on the combustion reaction with the voltage. Causing a tangible effect on the combustion reaction with the voltage may include causing the combustion reaction to be held or anchored by the charge element. For example, causing the combustion reaction to be held by the charge element may cause the combustion reaction to be held by the charge element peripheral to a fuel stream. According to respective embodiments, causing a tangible effect on the combustion reaction with the voltage includes: altering a flame shape (e.g., flattening or lengthening a flame), driving heat toward or away from a selected surface, increasing or decreasing the combustion reaction rate, increasing or decreasing a production of oxides of nitrogen (NOx), carbon monoxide (CO), and/or other reaction products, and controlling flame emissivity.

In step 712, electrical arcing between the charge element and the combustion reaction is limited or substantially eliminated. Especially under conditions of high voltage differences (e.g. if the combustion reaction is at a high voltage (high charge density) and the charge element is at ground or lower potential, or if the charge element has a high positive or negative voltage applied to it), the charge element may be subject to creating an electrical arc with the combustion reaction. The current limiting element is configured to prevent formation of an electrical arc. Additionally or alternatively, step 712 may include stopping an incipient electrical arc between the combustion reaction and one of a plurality of charge elements, by means of the corresponding one of the plurality of current limiting elements. The plurality of current limiting elements may collectively convey current between the electrical node and the plurality of charge elements in excess of an amount of current carried by an electrical arc while preventing the formation of such an arc. According to an embodiment, each of the plurality of current limiting elements individually has a current capacity that is below an amount of current carried by an electrical arc.

In step 714, heat from the combustion reaction is received with a heat transfer surface. According to an embodiment, the tangible effect caused in step 710 includes preferentially driving heat to the heat transfer surface.

Proceeding to step 716, a process is driven with the received heat. For example, driving a process with the received heat may include driving a propulsion system. In another embodiment, driving a process with the received heat includes delivering heat to a chemical process. In another embodiment, step 716 includes generating electricity.

According to an embodiment, the method 700 includes driving the combustion reaction to a majority charge or a to a flame voltage having a first polarity. The voltage established on the electrical node, in step 706, may include holding the electrical node at a voltage opposite in polarity from the majority charge or flame voltage or at a voltage ground. Referring to step 710, causing a tangible effect on the combustion reaction may include anchoring the combustion reaction at the charge element responsive to a current flow between the combustion reaction and the charge element.

The method 700 may include maintaining an electrical potential between the electrical node and the combustion reaction with the current limiting element. The method 700 may include using the current limiting element to cause the charge element to float to an electrical potential between an electrical potential of the combustion reaction and the voltage on the electrical node. According to an embodiment, the combustion reaction is caused to maintain contact with the charge element responsive to current limitation provided by the current limiting element.

Various units and unit symbols are used herein in accordance with accepted convention to refer to corresponding values. "MΩ" indicates a value of electrical resistance in mega-ohms. 1MΩ is equal to $1\times10^6$ ohms of resistance.

"kV" indicates a value of electric potential, in kilovolts. 1 kV is equal to $1\times10^3$ volts of electric potential. "μA" and "mA" indicate values of electrical current, in microamperes and milliamperes, respectively. 1 μA is equal to $1\times10^{-6}$ amperes of current, while 1 mA is equal to $1\times10^{-3}$ amperes of current. The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

While various aspects and embodiments have been disclosed herein, other aspects and embodiments are contemplated. Portions of one embodiment can be combined with elements of other embodiments, and/or with other elements known in the art, without departing from the spirit or scope of the disclosure. The various aspects and embodiments disclosed herein are for purposes of illustration and are not intended to be limiting, with the true scope and spirit being indicated by the following claims.

What is claimed is:

1. A combustion system, comprising:

a charge element configured to be disposed proximate to a combustion reaction;

an electrical node configured for electrical continuity with the charge element; and a current limiting element disposed to convey the electrical continuity from the electrical node to the charge element and to limit current flow between the electrical node and the charge element;

wherein the charge element is configured as a combustion reaction support surface;

wherein the combustion reaction is driven to a first voltage;

wherein the electrical node is held at a second voltage that is different from the first voltage; and wherein the combustion reaction support surface is configured to anchor the combustion reaction responsive to a current flow from the combustion reaction to the charge element.

2. The combustion system of claim 1, further comprising:

a propulsion system, a chemical process, or an electrical generation system operatively coupled to the heat transfer surface.

3. The combustion system of claim 1, further comprising a power supply, and wherein the electrical node includes an output from the power supply.

4. The combustion system of claim 1, wherein the electrical node includes a voltage ground.

5. The combustion system of claim 1, wherein the charge element includes a plurality of charge elements;

wherein the current limiting element includes a plurality of current limiting elements;

wherein each of the plurality of charge elements is held in electrical continuity with the electrical node through a corresponding one of the plurality of current limiting elements; and wherein each of the plurality of current limiting elements is configured to limit passage of electrical current, and thereby stop an incipient electrical arc extending between the combustion reaction and the corresponding one of the plurality of charge elements.

6. The combustion system of claim 1, wherein the charge element includes a plurality of electrodes;

wherein the current limiting element includes a plurality of current limiting elements; and wherein the plurality of current limiting elements are configured to collectively conduct electrical current between the electrical node and the plurality of charge elements that is greater than an amount of current carried by an electrical arc, and to individually limit current to below an amount of current carried by the electrical arc.

7. The combustion system of claim 1, wherein the current limiting element includes a linear current limiting element.

8. The combustion system of claim 7, wherein the current limiting element includes an electrical resistor.

9. The combustion system of claim 1, wherein the current limiting electrical element includes a nonlinear current limiting element.

10. The combustion system of claim 9, wherein the electrical element includes a switch.

11. The combustion system of claim 10, wherein the switch includes a transistor.

12. The combustion system of claim 1, wherein the charge element and current limiting element are integrated and are formed, at least in part, of a semiconductor material.

13. The combustion system of claim 3, wherein the current limiting element is integrated with the power supply.

14. The combustion system of claim 1, further comprising:

a power supply configured to output a voltage of 1000 volts or more;

a plurality of the charge element operatively coupled to the power supply and configured to provide electricity to the combustion reaction or to a region proximate the combustion reaction; and a plurality of the current limiting element, further comprising a charge element multiplexer operatively coupled between the power supply and the plurality of charge elements and configured to substantially prevent an electrical arc from forming between each of the plurality of charge elements and the combustion reaction.

15. The combustion system of claim 14, wherein the plurality of charge elements includes serrated electrodes.

16. The combustion system of claim 14, wherein the plurality of charge elements include sharp electrodes configured to eject charges into the region.

17. The combustion system of claim 16, wherein the region comprises a dielectric gap.

18. The combustion system of claim 14, wherein the charge element multiplexer is configured to limit current flow to each of the plurality of charge elements.

19. The combustion system of claim 14, wherein the charge element multiplexer comprises a plurality of current limiting elements each operatively coupled to the corresponding one of the plurality of charge elements.

20. The combustion system of claim 19, wherein the plurality of current limiting elements include electrically linear current limiting elements.

21. The combustion system of claim 20, wherein the plurality of current limiting elements include resistors.

22. The combustion system of claim 19, wherein the plurality of current limiting elements include electrically nonlinear current limiting elements.

23. The combustion system of claim 22, wherein the plurality of current limiting elements include switches.

24. The combustion system of claim 23, wherein the plurality of current limiting elements include semiconductor devices.

25. The combustion system of claim 24, wherein the plurality of current limiting elements include varistors.

26. The combustion system of claim 14, further comprising a conductive fuel nozzle tip electrically coupled to ground.

27. The combustion system of claim 14, further comprising an anchor electrode configured to receive, supply, or receive and supply current to the combustion reaction, wherein the received, supplied, or received and supplied current is selected to anchor the combustion reaction to the anchor electrode;

further comprising a current transmission device operatively coupled between the anchor electrode and the power supply or between the anchor electrode and a electricity ground;

wherein the charge element multiplexer includes a plurality of current limiting elements operatively coupled to the plurality of charge elements;

wherein the plurality of current limiting elements are each configured to limit current to each corresponding charge element to an amperage substantially equal to the amperage passed through the current transmission device to the anchor electrode divided by the number of charge elements and corresponding current limiting elements;

wherein the current transmission device includes a total current sensor;

wherein the charge element multiplexer includes a plurality of current limiting elements operatively coupled to the plurality of charge elements; and wherein each current limiting element includes a channel current sensor and a corresponding switch configured to limit current to an amperage substantially equal to a current measured by the total current sensor divided by the number of current limiting elements.

28. The combustion system of claim 1, wherein the charge element further comprises combustion fluid configured to apply electricity to the combustion reaction;

the combustion system further comprising a segmented anchor electrode configured to anchor the combustion reaction, the segmented anchor electrode including a plurality of electrode segments; and wherein the current limiting element further comprises a charge element multiplexer including a plurality of current limiting elements operatively coupled between the segmented anchor electrode and an electricity ground.

29. The combustion system of claim 28, wherein each of the current limiting elements is operatively coupled between a corresponding electrode segment and the electricity ground.

30. The combustion system configured for enhanced flame holding of claim 28, further comprising a conductive fuel nozzle operatively coupled to the electricity ground.

31. The combustion system configured for enhanced flame holding of claim 28, further comprising a power supply configured to apply the electricity to the charger.

32. The combustion system configured for enhanced flame holding of claim 28, wherein the electrode segments are separated from one another.

* * * * *